United States Patent [19]

Bruchmann et al.

[11] Patent Number: 4,734,041

[45] Date of Patent: Mar. 29, 1988

[54] ELECTRICAL POWER CONNECTOR

[75] Inventors: Richard A. Bruchmann, Blaine; Michael D. Halvorsen, Coon Rapids, both of Minn.

[73] Assignee: Control Data Corporation, Minneapolis, Minn.

[21] Appl. No.: 65,201

[22] Filed: Jun. 22, 1987

[51] Int. Cl.[4] ..... H01R 13/04

[52] U.S. Cl. ..... 439/637; 439/924

[58] Field of Search ..... 439/629–637, 439/668, 669, 924

[56] References Cited

U.S. PATENT DOCUMENTS

| | | | |
|---|---|---|---|
| 2,762,026 | 9/1956 | Knohl . | |
| 2,924,809 | 2/1960 | Wilson . | |
| 3,149,893 | 9/1964 | Dupre . | |
| 3,289,146 | 11/1966 | Tuchel . | |
| 3,559,146 | 1/1971 | Valtonen . | |
| 3,611,275 | 10/1971 | Leddy et al. . | |
| 3,631,381 | 12/1971 | Pittman . | |
| 3,731,259 | 5/1973 | Occhipinti . | |
| 4,531,793 | 7/1985 | Hochgesang et al. . | |
| 4,590,343 | 5/1986 | Berta et al. . | |
| 4,607,907 | 8/1986 | Bogursky . | |
| 4,634,210 | 1/1987 | Crawford . | |
| 4,636,021 | 1/1987 | Bobb et al. | 439/636 |
| 4,684,194 | 8/1987 | Jenkins et al. | 439/636 |

*Primary Examiner*—Joseph H. McGlynn

*Attorney, Agent, or Firm*—Joseph A. Genovese; Mark A. Wurm

[57] ABSTRACT

An electrical power connector for PC boards or bus bars having low insertion force and low voltage drop across the connector. The connector features a female receptacle having a double set of opposing rows of multipoint spring contacts mating with a two-tiered male plug. The spring contacts make electrical contact to the tiers of the male plug.

10 Claims, 3 Drawing Figures

ELECTRICAL POWER CONNECTOR

BACKGROUND OF THE INVENTION

The present invention relates to electrical connectors for printed circuit board applications. More particularly, the invention relates to a multi-point electrical power connector having a mating male plug and female receptacle. The electrical power connector features a low insertion force between the mating connector parts and a low voltage drop across the connector while carrying many amps of electrical power.

Printed circuit boards have become widely used in a plethora of electronic applications. As electrical circuits become increasingly compact, it is necessary to provide large amounts of electrical power to an individual printed circuit board. There is a need for a connector to provide large amounts of electrical power to a PC board while maintaining a low voltage drop across the connector to reduce heat and power loss.

Printed circuit boards are seldom hardwired into an electronic assembly, but are most often connected by tabbed ends, which act as a male blade for insertion into a female receptacle. For high power connections of PC boards to a bus bar an adapter is often mounted on the circuit board. The present invention provides a low insertion force electrical power connector for PC board connections within an electronic assembly. Many prior art connectors require an alignment between the male and female part to mate the power to the printed circuit board which increases the risk of a logic connector misalignment. The present design does not require alignment of the fixtures and misalignment in one direction still permits proper function of the electrical power connector.

SUMMARY OF THE INVENTION

The present invention is an electrical power connector comprising a coacting mating plug and receptacle. The male plug is a two-tiered, knife-shaped blade, having rounded front edge and shoulder, adapted to be mounted to a printed circuit board and mate with a female receptacle. The female receptacle has two rows of finger-spring contacts mounted to a metallic bus bar. The spacing between the two rows of contact fingers on the female receptacle is different than the spacing between the tiers of the male blade so that during insertion, both sets of contacts will not be forced to spread apart at the same time, thereby providing low insertion force for the connector. The multiple contact points provide high throughput of electrical power, namely current, with only a minimal voltage drop.

DETAILED DESCRIPTION OF THE PREFERRED EMBODIMENTS

Figure 1:
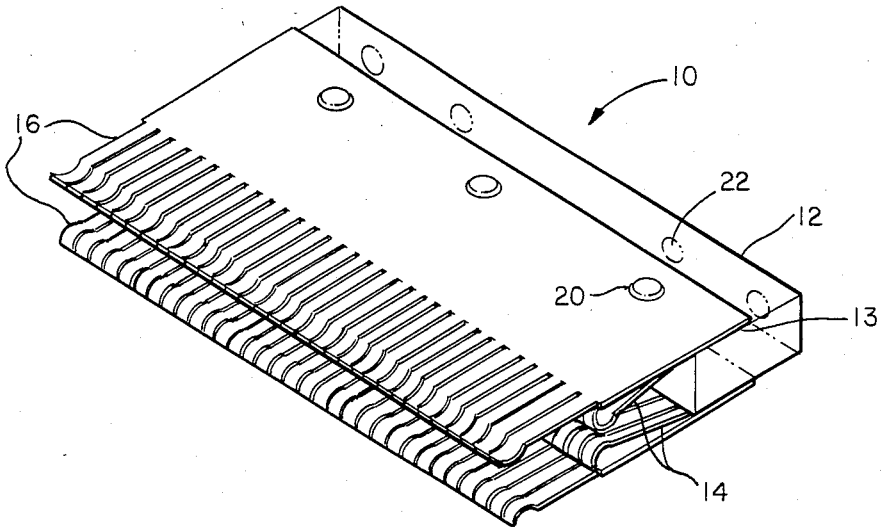
FIG. 1 is a perspective view of the female receptacle portion of the present invention.
Figure 2:
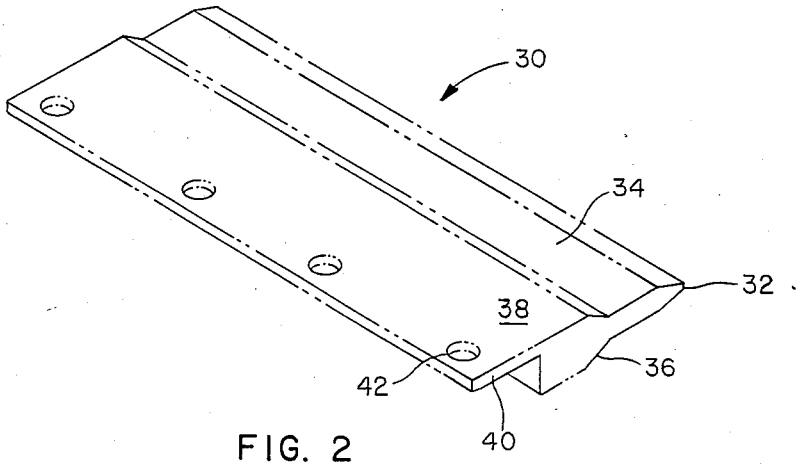
FIG. 2 is a perspective view of the male plug portion of the electrical power connector.

Shown in FIG. 1 is the female receptacle portion 10 of the electrical power connector. The female receptacle 10 consists of a solid bar 12 made of high-conductivity metal having attached on each side two rows of multi-fingered spring metal. The inner rows of spring fingers 14 are shorter than the outer rows of spring finger metal 16. The two rows of spring-clip metal are mounted to each side of bar 12 via rivets 20. As an additional electrical contact, solder 18 is used in between the bar and the inner strip, as well as between the inner and outer finger strips to promote good electrical contact. Holes 22 in bar 12 allow for mounting of the female connector portion to a bus bar or other power source.

Adapted for mating with the female portion is the male plug portion 30 of the electrical power connector. The leading edge of the male plug member is a knife-shaped blade, having rounded front edge 32 leading to a flat, first-tier region 34. The thickness of region 34 is designed to mate with the inner spring finger strips 14 of the female plug connector at a low insertion force. Shoulder 36 of the male plug connector 30 leads to a thicker second-tier region on the male plug connector detailed as 38. Region 38 is designed to mate with the outer rows of spring-finger connector strips 16, again, requiring only a low insertion force. The trailing edge 40 of the male plug portion is designed to overlay one edge of a printed circuit board and to be securely fastened to a printed circuit board via fasteners in holes 42. Additionally, solder can be used directly between the trailing edge portion 40 and a printed circuit board. The single side design of the trailing edge 40 promotes good contact to a PC board, withough the need of close tolerance control of the board to male plug spring.

Figure 3:
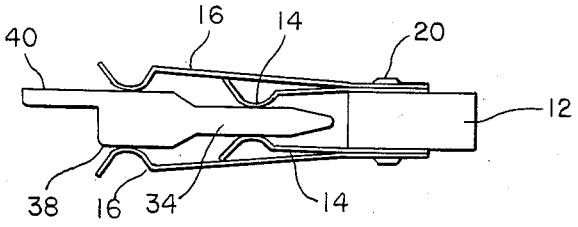
FIG. 3 is a side plan view of the electrical power connector.

Shown in FIG. 3 is the electrical power connector mated as in use. Shown in this plan side view is the bus bar 12 having inner rows of spring fingers 14 and outer row spring fingers 16 attached via rivet 20. Both inner and outer rows of spring-contact fingers are spread apart with the inner row 14 riding upon the first tier of the male plug member 34 and the outer row of spring fingers compressing against the second tier area 38 of the male plug member. The trailing edge of the male plug member 40 is available for connection to a PC board.

The spring contact members are made of beryllium-copper and can be procured from various manufacturers such as Instrument Specialties Company, Inc., P. 0. Box A, Delaware Water Gap, Pa. 18327. Gold or silver can be plated to various portions of the finger springs to enhance electrical contact with the male plug. The bus bar can be made from hard drawn copper having reduced in oxygen content with high electrical conductivity. In volume manufacturing it is anticipated that the male plug portion of the electrical power connector be made by extrusion of copper, with fastening holes machined in later.

It is anticipated that various modifications to the design presented could be made by one skilled in the art without varying from the scope of the claim mentioned.

What is claimed is:

1. An electrical power connector comprising a coacting mating plug and female receptacle, the male plug comprising a blade having first and second thickness tiers with a rounded front end and a rounded shoulder transition between the tiers, the trailing edge of the blade extending from one surface of the second tier and adapted for delivery of electrical power, the female receptacle comprising a bar of conductive material having a first and second pair of parallel rows of multi-point spring contacts, the first row pair adapted to mate with the first tier of the mating male plug, the second row extending past the first row and adapted to mate with the second tier of the male plug portion.

2. The connector of claim 1 wherein the spacing between first row of multipoint spring contacts and second row of multipoint spring contacts is greater than the width of the first tier of the male plugs.

3. The connector of claim 1 wherein the trailing edge of the male plug blade is adapted to deliver power to a printed circuit board.

4. The connector of claim 1 wherein the multipoint spring contacts are plated with gold or silver.

5. An electrical power connector comprising a coacting mating male plug and female receptacle, the male plug comprising a blade having a plurality of thickness tiers, the plug having a round front end with rounded transitions between tiers, the trailing edge of the male plug extending adapted for delivery of electrical power, the female receptacle comprising a bar of conductive material having a plurality of pairs of parallel rows of multipoint spring contacts, the rows adapted to mate in electrical contact with corresponding tiers of the male plug.

6. The connector of claim 5 wherein the spacing between adjacent parallel rows of multipoint spring contacts is greater than the width of the tiers of the male plug.

7. The connector of claim 5 wherein the trailing edge of the male plug blade is adapted to deliver power to a printed circuit board.

8. The connector of claim 5 wherein the multipoint spring contacts are plated with gold or silver.

9. The connector of claim 7 wherein the trailing edge of the extends from the surface of a tier forming a plate for mounting to a printed circuit board.

10. The connector of claim 9 wherein the plate has opening for mounting to a printed circuit board.

* * * * *